US008267248B2

(12) United States Patent
Kollmuss

(10) Patent No.: US 8,267,248 B2
(45) Date of Patent: Sep. 18, 2012

(54) SHRINK PACK AND METHOD FOR MAKING A SHRINK PACK

(75) Inventor: Manuel Kollmuss, Riedering (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/713,291

(22) Filed: Feb. 26, 2010

(65) Prior Publication Data

US 2010/0236195 A1 Sep. 23, 2010

(30) Foreign Application Priority Data

Mar. 23, 2009 (DE) ..... 10 2009 003 653

(51) Int. Cl.
*B65D 75/00* (2006.01)

(52) U.S. Cl. ..... 206/432; 206/497; 383/125

(58) Field of Classification Search ..... 206/150, 206/151, 427, 432, 497, 459.1, 820; 294/87.2; 229/87.05; 383/120, 123–125
See application file for complete search history.

(56) References Cited

U.S. PATENT DOCUMENTS

| | | | | |
|---|---|---|---|---|
| 3,866,386 | A | 2/1975 | Ganz | |
| 4,377,234 | A * | 3/1983 | Kaplan | 206/432 |
| 4,586,312 | A * | 5/1986 | Limousin | 53/412 |
| 4,658,963 | A * | 4/1987 | Jud | 229/87.05 |
| 4,700,528 | A | 10/1987 | Bernard | |
| 5,067,612 | A * | 11/1991 | Tsuchiya et al. | 206/497 |
| 2002/0162766 | A1 * | 11/2002 | Saso et al. | 206/497 |
| 2007/0215506 | A1 * | 9/2007 | Hartness et al. | 206/432 |
| 2009/0071102 | A1 | 3/2009 | Cerf | |

FOREIGN PATENT DOCUMENTS

| | | | |
|---|---|---|---|
| DE | 2212728 | A1 | 9/1973 |
| EP | 0432028 | A1 | 6/1991 |
| EP | 0890514 | A1 | 7/1997 |
| FR | 1283221 | A | 2/1962 |
| FR | 2602748 | A1 | 2/1988 |

OTHER PUBLICATIONS

Extended European Search Report mailed on Mar. 3, 2010.

* cited by examiner

*Primary Examiner* — Luan K Bui
(74) *Attorney, Agent, or Firm* — Patentbar International P.C.

(57) ABSTRACT

A method for making a shrink pack (1) is disclosed wherein pre-cut films (10, 11) of a shrinkable film (3) are cut off diagonally to a longitudinal direction (30) of the film (3). The pre-cut films (10, 11) are wrapped in each case about at least two articles (2). The pre-cut films (10, 11) are shrinked onto the wrapped articles (2) to form a shrink pack (1) in each case. The film (3) is cut before the shrink-on process and before the cutting off into pre-cut films (10, 11) respectively into at least two film webs (4, 5, 6, 7) along the longitudinal direction (30). Then, at least two adjacent film webs (4, 5, 6, 7) are brought together at their adjacent sides (14, 15, 16, 17) in longitudinal direction (30) such that they form an overlap (9) with a width (31) at the adjacent sides (14, 15, 16, 17). A shrink pack (1) is also disclosed.

7 Claims, 2 Drawing Sheets

SHRINK PACK AND METHOD FOR MAKING A SHRINK PACK

RELATED APPLICATIONS

This application claims priority to German Patent Application No. DE 10 2009 003 653.9, filed on Mar. 23, 2009, which is incorporated herein by reference in its entirety.

FIELD OF THE INVENTION

The present invention relates to a method for making a shrink pack.

The invention also relates to a shrink pack.

BACKGROUND OF THE INVENTION

Methods and devices for the packing of articles (packaged goods) are known from the prior art wherein said methods and devices use a shrinking film as package wrapping for the items. This shrinking film is usually provided as endless material on rolls. The width of the shrink foil is chosen such that it is broader by a specific measurement than the footprint of the wrapped articles arranged to a pack.

In a known device two or more packs can parallely be made by providing the film with a width which corresponds to the double or multiple width of a single pack. The film is then cut in the device into two or more film webs by a cutting unit. The cut film webs are brought to a clearance to each other by a film spreader unit, wherein said clearance is determined from the clearance of the pack formations to be packed in the device.

The shrink foil is separated within the packing device according to the pack dimensions. The film webs are then wrapped about the articles by a wrapping system within the device. Finally, the packs are transported through a shrink tunnel whereby the shrink foil comes into close contact with the articles and the finished shrink packs are formed.

The disadvantage of a shrink pack is that it does not have any structural features which may be suitable for a carrying handle for example. In the prior art, however, methods and devices are known which provide such a carrying handle.

Patent Application FR 2602748 A1 discloses a shrink film package about containers. A support handle is formed by an annular tape wound in an intermediate plane separating the rows of containers. The annular tape is placed on the outside of the envelope sheet in a groove formed between the rows of containers. A reinforcing strip can be provided to prevent the shearing of the bottom of the envelope by the edges of the tape.

U.S. Pat. No. 4,700,528 A discloses a method for making a shrink pack for articles to be packed, wherein a separate handle in form of a tape is bonded to a heat shrinkable film, and the film is weakened along the edges of a central portion of the length of tape. The film is then wrapped around an article or articles, has its two opposite ends sealed together, and is heat shrunk around the article or articles causing access openings in the sheet in the weakened areas along the central portion of the tape that can then be used as a handle for the resultant package.

It is disadvantageous in the prior art that a further machine and additional extensive production steps are necessary for applying the tapes. Then there is also the fact that the already pre-assembled wrapping material can be used only for one single pack type. A conversion of the machine is always necessary when other pack types shall be used.

U.S. Pat. No. 3,866,386 A discloses a method and apparatus for making a shrink pack for articles. One or more local reinforcing laminations, such as filaments beads or pleats are formed in the film prior to wrapping the containers, the location of such laminations being such as to form a tough handle region, for ready portability of the packaged cluster. The preformed nature of the lamination is to withstand such local film tensions as develop in the course of heat-shrinking to consolidate the packaged cluster. Various forms of lamination, and methods and means of making the same, are shown and described.

SUMMARY OF THE INVENTION

It is the object of the invention is to provide a method for making a shrink pack with a reduced number of process steps, reduced use of materials and an overall cost-saving, wherein the shrink pack has a carrying handle.

The above object is achieved with a method comprising the steps of:

cutting off pre-cut films of a shrinkable film along a longitudinal direction of the film, to form at least two film webs along the longitudinal direction of the film;

bringing at least two adjacent film webs together at their adjacent sides in longitudinal direction in such a way that they form an overlap with a defined width at the adjacent sides;

wrapping in each case the pre-cut films around at least two articles; and shrinking the pre-cut films onto the wrapped articles to form a shrink pack.

Furthermore, the object of the invention is to provide a shrink pack with a carrying handle which needs little use of material and is cost-saving.

The above object is achieved with a shrink pack comprising:

two pre-cut films, are provided with an overlap with a width at their adjacent sides; and at least two articles, which are wrapped with a shrinkable film having the overlap.

With the method according to the invention, the film is cut either prior to its cutting into pre-cut films or, however, at least into two film webs along the longitudinal direction of the film prior to the shrink-on process. At least two adjacent film webs are then brought together at their adjacent sides in the longitudinal direction such that they form an overlap with a width at the adjacent sides. The overlap causes that the film lies in a doubled manner in these portions, also after the shrink process. Thus, one receives after the shrink process a fortified film strip in this portion of the film which serves as a firm carrying handle for the respective shrink pack and which also runs as a whole about the pack. It is advantageous that no additional strip of material is needed for a carrying handle.

For easy visual recognition as for where the overlap shall be positioned on the film and as for where the user shall tear off the perforation respectively in order to use the overlap as a carrying handle, the overlap and the perforations respectively can be marked on the film by means of visually recognizable features, for example having a color marking on the film.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Same elements refer to same reference numbers throughout the various figures. Furthermore, only reference numbers which are necessary for the description of the respective figure are shown for the sake of clarity in the various figures. The shown embodiments are only examples of how the method according to the invention can be designed and shall not be regarded as limiting the invention.

Figure 1:
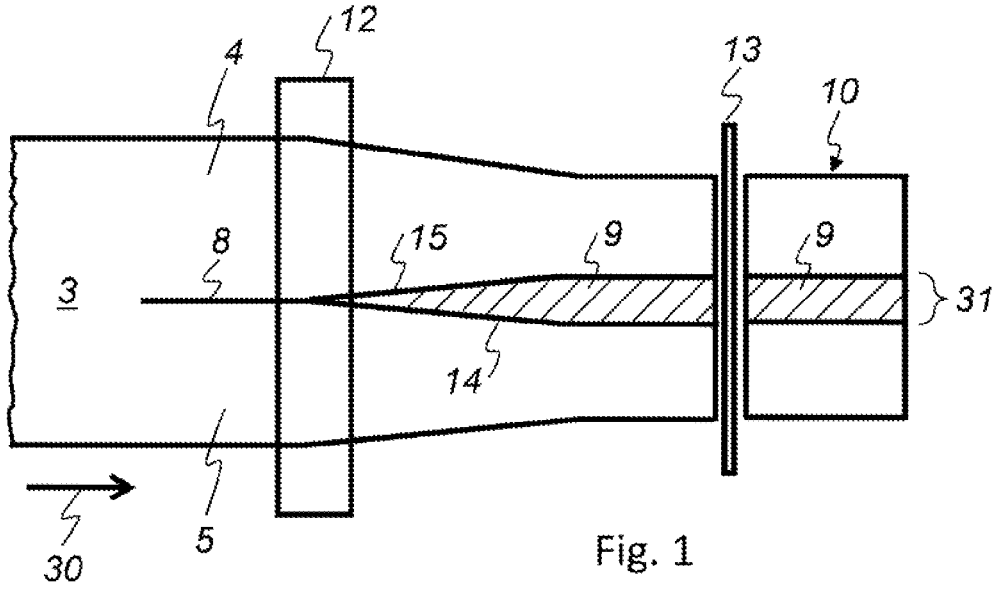
FIG. 1 shows a top view of a film which is cut into two film webs.

FIG. 1 shows a top view of a film 3, which is cut into two film webs 4, 5. The film 3 is for example provided from a roll (not shown). In the embodiment shown here, the film 3 is cut with one cut by a cutting unit (not shown) along the cutting line 8 into two film webs 4, 5 of the same width.

The film web 4 has a lower side 14, the film web 5 has an upper side 15, wherein the sides 14, 15 overlap prior to the cutting of the film. A film guiding unit 12 brings the cut film webs 4, 5 at their adjacent sides 14, 15 together in longitudinal direction 30, that is it brings them to each other in their midst. Thus, an overlap 9 of the two webs 4, 5 with a width 31 is formed.

A cutting unit 13 cuts one pre-cut film 10 after the other off the film 3 in each case consecutively with reference to the longitudinal direction 30, wherein only one single film web 10 is shown in FIG. 1. Each pre-cut film 10 consists basically of two-parts, consisting of a cut web of the film web 4 and a cut web of the film web 5. The pre-cut film 10 is also provided with an overlap 9. By the shrink process, the two film portions of the overlap 9 which are on top of each other remain one upon the other so that the overlap forms a stable carrying handle 20 of the shrink pack 1 (see FIG. 3).

The overlap 9 is shown in cross hatch on the film 3 in the embodiment shown here.

FIG. 2 shows once again a top view of the pre-cut film 10 according to FIG. 1, wherein perforations 24, 25 are formed in the pre-cut film 10 laterally of the overlap 9 by which a user can easier seize the carrying handle 20 (see FIG. 1) formed by the overlap 9. The perforations 24, 25 are provided in the embodiment shown here with a clearance to the overlap 9, which at least to the half of the width 31.

It is obvious for a person skilled in the art that the perforations 24, 25 can also be formed after the shrink process and that the perforations 24, 25 can be formed by short longitudinal cuts, by punctual penetrations such as needles basically linearly arranged, or by laser treatment. FIG. 3 shows a perspective view of a shrink pack 1 with a carrying handle 20 which is formed by the overlap 9 of the two film webs 4, 5 of the pre-cut film 10. At least two articles 2 are folded with the pre-cut film 10 according to FIGS. 1 and 2 respectively such that they form the shrink pack 1, and the overlap 9 according to FIGS. 1 and 2 respectively of the two film webs 4, 5 forms the carrying handle 20 for the shrink pack 1.

Figure 4:
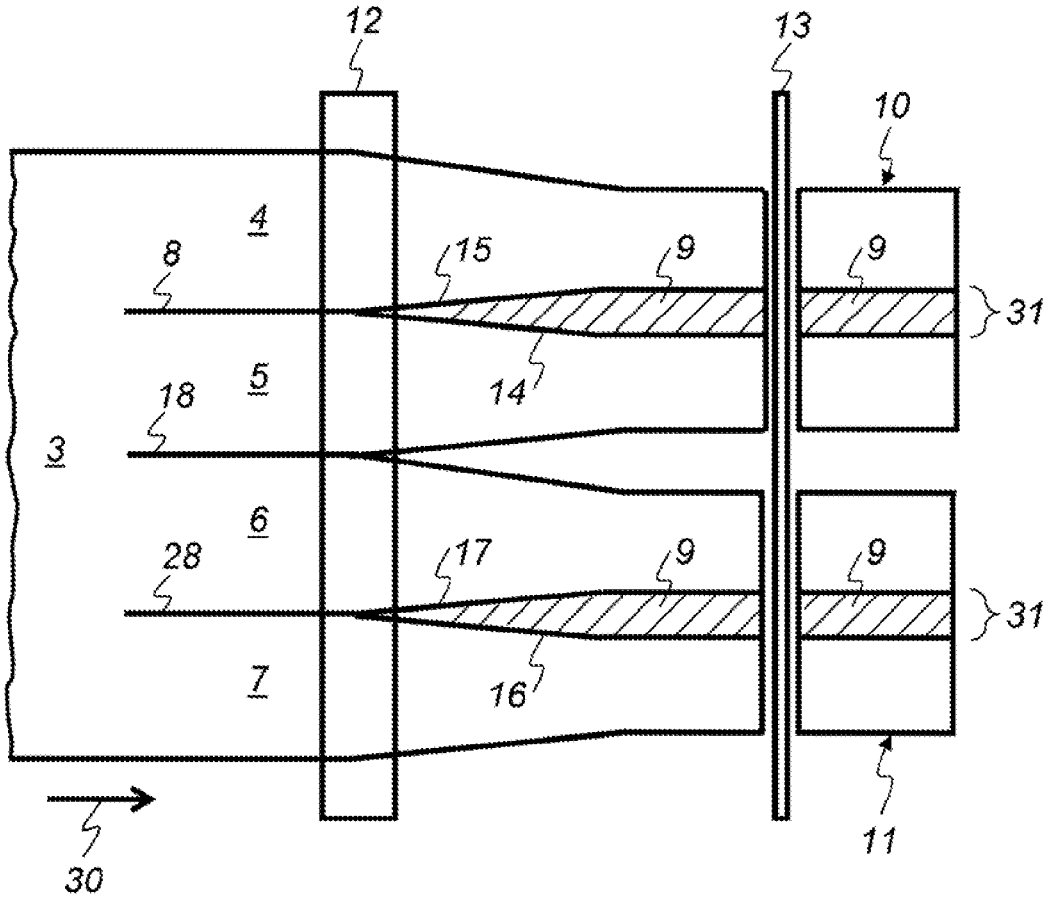
FIG. 4 shows a top view of a film which is cut into four film webs.

FIG. 4 shows a top view of a film 3, which is cut with three cuts in four film webs 4, 5, 6, 7 of the same width along the cutting lines 8, 18, 28. The upper two adjacent film webs 4, 5 are provided with an overlap 9 and the lower two adjacent film webs 6, 7 are likewise provided with an overlap 9. The pair 4, 5 forms the wrapping material for a shrink pack 1 in each case, and the pair 6, 7 forms the wrapping material for another shrink pack 1. The pairs 4, 5 and 6, 7 can be wrapped and shrinked parallely with the respective wrapping material about the respective articles 2. The two wrapping materials are the two pre-cut films 10, 11. The film web 4 has a lower side 14, the film web 5 has an upper side 15, wherein the sides 14, 15 overlap prior to the cutting of the film. The film web 6 is provided with a lower side 16, the film web 7 is provided with an upper side 17, wherein the sides 16, 17 overlap prior to the cutting of the film.

Figure 2:
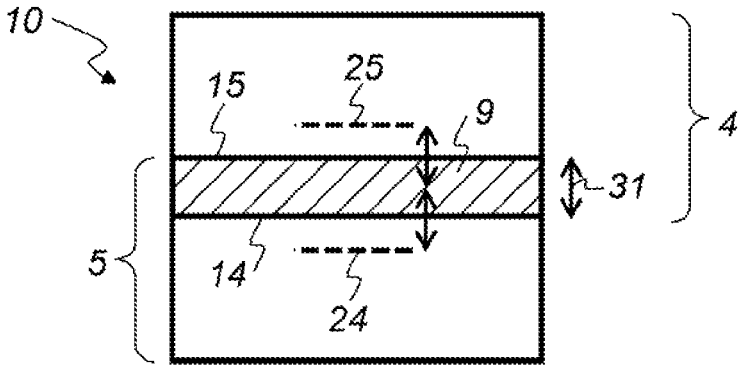
FIG. 2 shows a top view of a pre-cut film whose two film webs have an overlap.
Figure 3:
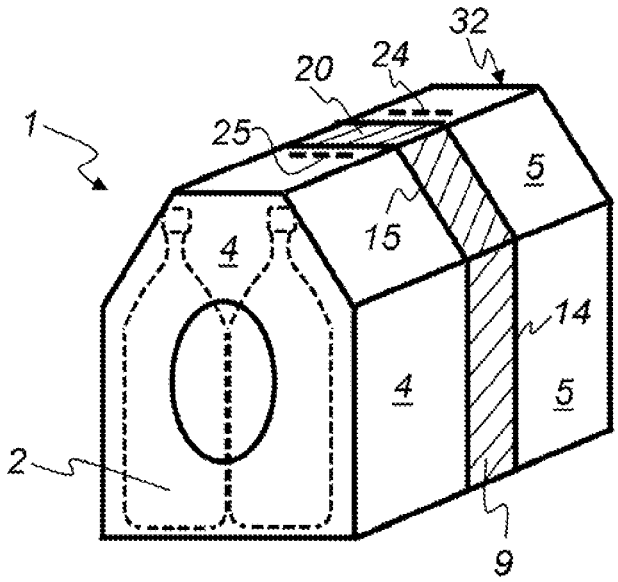
FIG. 3 shows a perspective view of a shrink pack with a carrying handle which is formed by an overlap of two pre-cut films of a pre-cut film.

The pre-cuts 10, 11, the overlaps 9, as well as the making of the packs 1 are apart from that already described in FIGS. 1 to 3.

While this invention has been particularly shown and described with references to preferred embodiments thereof, it will be understood by those skilled in the art that various changes in form and details may be made therein without departing from the scope of the invention encompassed by the appended claims.

What is claimed is:

1. A shrink pack comprising:

a film cut into two shrinkable films, wherein the two pre-cut shrinkable films overlapping adjacent film sides form an overlap in a longitudinal direction; and at least two articles wrapped with the two pre-cut shrinkable films having the overlap;

wherein, after shrinking, the overlap forms a fortified film strip running around the entire shrink pack and the fortified film strip overlap forms a carrying handle for the shrink pack; and wherein at least one perforation is placed at a clearance with respect to the overlap on the top of the shrink pack after shrinking so a user can seize the carrying handle.

2. The shrink pack of claim 1, wherein a width of the overlap is between 20 and 60 mm.

3. The shrink pack of claim 2, wherein a width of the overlap is 30 mm.

4. The shrink pack of claim 1, wherein at least one of the two pre-cut shrinkable films comprises at least one lateral perforation at a clearance with respect to the overlap.

5. The shrink pack of claim 4, wherein each of the at least one perforation is formed at a clearance with respect to the overlap on the top of the shrink pack after the shrinking.

6. The shrink pack of claim 5, wherein the clearance is at least a half of a width of the overlap.

7. The shrink pack of claim 1, wherein the fortified film strip is free of perforations.

* * * * *